US012522893B2

(12) United States Patent
Yao et al.

(10) Patent No.: US 12,522,893 B2
(45) Date of Patent: Jan. 13, 2026

(54) WEAR AND CORROSION RESISTANT ALLOY COMPOSITIONS

(71) Applicant: KENNAMETAL INC., Latrobe, PA (US)

(72) Inventors: Matthew Yao, Belleville (CA); Abdelhakim Belhadjhamida, Belleville (CA); Don Williams, Belleville (CA)

(73) Assignee: KENNAMETAL INC., Latrobe, PA (US)

( * ) Notice: Subject to any disclaimer, the term of this patent is extended or adjusted under 35 U.S.C. 154(b) by 0 days.

(21) Appl. No.: 17/824,498

(22) Filed: May 25, 2022

(65) Prior Publication Data

US 2024/0018630 A1 Jan. 18, 2024

(51) Int. Cl.
*C22C 19/07* (2006.01)

(52) U.S. Cl.
CPC ..... *C22C 19/07* (2013.01)

(58) Field of Classification Search
CPC ..... C22C 1/0433; C22C 19/07; C22C 38/105; C22C 38/44; C22C 38/52; F16K 25/005; F01L 2301/00; F01L 2303/00; F01L 2820/01; F01L 3/02
USPC ..... 420/440
See application file for complete search history.

(56) References Cited

U.S. PATENT DOCUMENTS 4,961,781 A * 10/1990 Morishita ..... C22C 32/0073 419/12
7,572,408 B2 * 8/2009 Wu ..... C22C 19/07 420/440
11,155,904 B2 * 10/2021 Qiao ..... C22C 38/52
2005/0142026 A1 * 6/2005 Wu ..... B22F 7/04 420/436
2011/0268989 A1 * 11/2011 Suzuki ..... C22F 1/00 428/668
2018/0066342 A1 * 3/2018 Kamo ..... C22C 19/07
2021/0010113 A1 * 1/2021 Qiao ..... C22C 38/008

FOREIGN PATENT DOCUMENTS

CN 114457271 B * 9/2022
JP 05084592 A * 4/1993 ..... F01L 3/04

OTHER PUBLICATIONS

NPL: on-line translation of CN 114457271 B, Sep. 2022 (Year: 2022).*
NPL: on-line translation of JP-05084592-A Abstract, Apr. 1993 (Year: 1993).*
Kennametal, Stellite 6 Alloy, Technical Data Sheet, 2021, Kennametal Stellite, United States.

(Continued)

*Primary Examiner* — Jie Yang
(74) *Attorney, Agent, or Firm* — Christopher J. Owens

(57) ABSTRACT

Alloy compositions and associated articles are described herein which, in some embodiments, exhibit enhancements to ductility and processing capabilities without significant sacrifices to hardness, wear resistance, and/or corrosion resistance. An alloy, in some embodiments, comprises 0-40 wt. % nickel, 14-20 wt. % chromium, 24-35 wt. % molybdenum, 0-15 wt. % iron, 0-1.5 wt. % manganese, 0.01-0.1 wt. % carbon, 0-15 wt. % tungsten, and the balance cobalt, wherein the alloy has a configurational entropy greater than 1.5R, where R is the universal gas constant.

23 Claims, 6 Drawing Sheets

(56) References Cited

OTHER PUBLICATIONS

Kennametal, Tribaloy T-400/T0400C Alloys, Technical Data Sheet, 2021, Kennametal Stellite, United States.
Kennametal, Tribaloy T-401 Alloy, Engineering Specification Sheet, Jan. 26, 2005, Kennametal, United States.
Kennametal, Tribaloy T-700, Product Description, Kennametal,2022, United States.
Kennametal, Tribaloy T-800 Alloy, Technical Data Sheet, 2021, Kennametal Stellite, United States.
Jan. 4, 2025 Foreign Office Action Chinese Application No. CN202310501450.8, 02 Pages.

* cited by examiner

WEAR AND CORROSION RESISTANT ALLOY COMPOSITIONS

FIELD

The present invention relates to wear and corrosion resistant alloy compositions and, in particular, to alloy compositions exhibiting enhancements to ductility and processing capabilities.

BACKGROUND

Stellite alloys offer a desirable balance of mechanical wear resistance and corrosion resistance. Stellite alloys are generally cobalt-based with additions of chromium, carbon, tungsten and/or molybdenum. The lower carbon alloys can find application in cavitation, sliding wear or moderate galling, while the higher carbon alloys are usually selected for abrasion, severe galling, or low angle erosion. In addition to the Stellite family, Tribaloy alloy compositions have also been developed for applications in which extreme wear is combined with high temperatures and corrosive environments. Tribaloy alloys can be cobalt-based or nickel-based, depending on end use. Wear resistant Stellite and Tribaloy alloys are often formed with various hard phases such, as carbides and intermetallic compounds. Such hard phases can render the alloys brittle and prone to cracking and/or other failure mechanisms. Alloy brittleness can also lead to processing issues, including degradation during application by thermal spray, welding or casting.

SUMMARY

In view of the foregoing disadvantages, alloy compositions and associated articles are described herein which, in some embodiments, exhibit enhancements to ductility and processing capabilities without significant sacrifices to hardness, wear resistance, and/or corrosion resistance. An alloy, in some embodiments, comprises 0-40 wt. % nickel, 14-20 wt. % chromium, 24-35 wt. % molybdenum, 0-15 wt. % iron, 0-1.5 wt. % manganese, 0.01-0.1 wt. % carbon, 0-15 wt. % tungsten, 0.5-5.5 wt. % silicon and the balance cobalt, wherein the alloy has a configurational entropy greater than 1.5R, where R is the universal gas constant. In some embodiments, the configurational entropy is up to 1.7R. In another aspect, an alloy comprises 0-40 wt. % nickel, 14-20 wt. % chromium, 24-35 wt. % molybdenum, 0-15 wt. % iron, 0-1.5 wt. % manganese, 0.01-0.1 wt. % carbon, 0-15 wt. % tungsten, 0.5-5.5 wt. % silicon and the balance cobalt, wherein the alloy has a magnetic permeability (μ) less than 1.005.

In another aspect, articles comprising alloys described herein are provided. In some embodiments, an article comprises one or more regions formed of an alloy comprising a cobalt rich solid solution matrix phase and intermetallic precipitates dispersed in the matrix phase, the intermetallic precipitates having a discontinuous dendritic microstructure, wherein the alloy comprises 0-40 wt. % nickel, 14-20 wt. % chromium, 24-35 wt. % molybdenum, 0-15 wt. % iron, 0-1.5 wt. % manganese, 0.01-0.1 wt. % carbon, 0-15 wt. % tungsten, 0.5-5.5 wt. % silicon, and the balance cobalt. The intermetallic precipitates, in some embodiments, comprise Laves phases.

These and other embodiments are further described in the following detailed description.

DETAILED DESCRIPTION

Figure 1A:
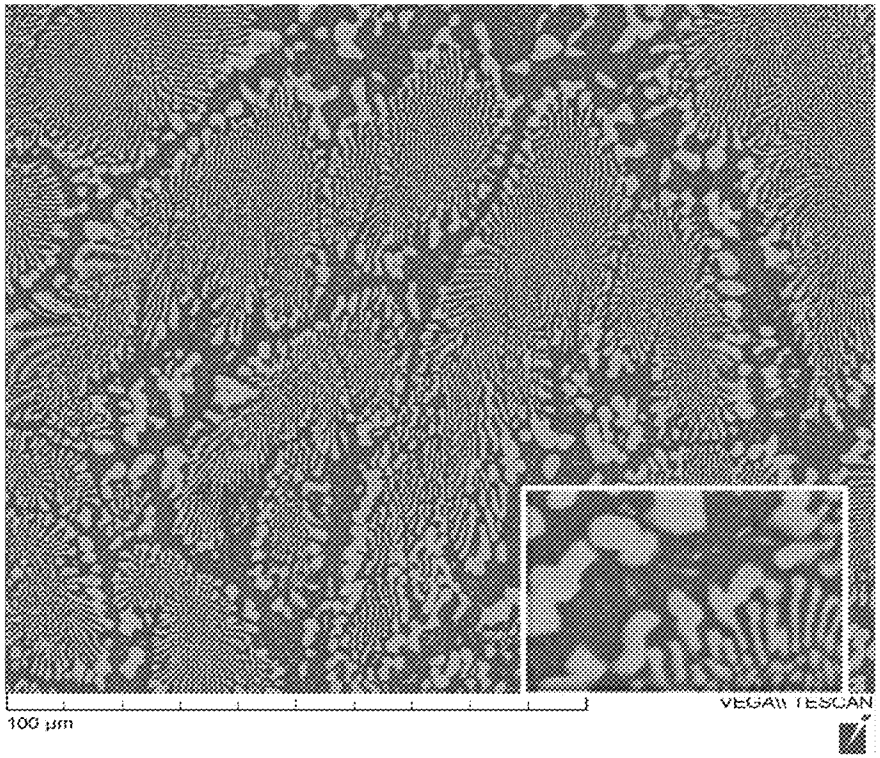
FIG. 1A is a scanning electron micrograph (SEM) illustrating Laves phases of a cast alloy described herein according to one embodiment.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

I. Alloy Compositions

In one aspect, an alloy comprises 0-40 wt. % nickel, 14-20 wt. % chromium, 24-35 wt. % molybdenum, 0-15 wt. % iron, 0-1.5 wt. % manganese, 0.01-0.1 wt. % carbon, 0-15 wt. % tungsten, 0.5-5.5 wt. % silicon, and the balance cobalt, wherein the alloy has a configurational entropy greater than 1.5R, where R is the universal gas constant. In some embodiments, the configurational entropy is up to 1.7R. Configuration entropy of the alloy composition can be determined according to the following equation:

$$S_{conf} = -R\sum_{i=1}^{n} x_i \ln(x_i)$$

where R is the universal gas constant and xi is the molar concentration of the ith alloying element which satisfies:

$$\sum_{i=1}^{n} x_i$$

Moreover, in some embodiments, the alloy composition has a magnetic permeability (μ) less than 1.005. Magnetic permeability of the alloy composition, for example, can range from 1.000-1.003. Magnetic permeability is measured according to ASTM A342-Standard Test Methods for Permeability of Weakly Magnetic Materials.

In another aspect, an alloy comprises 0-40 wt. % nickel, 14-20 wt. % chromium, 24-35 wt. % molybdenum, 0-15 wt. % iron, 0-1.5 wt. % manganese, 0.01-0.1 wt. % carbon, 0-15 wt. % tungsten, 0.5-5.5 wt. % silicon, and the balance cobalt, wherein the alloy has a magnetic permeability GO less than 1.005.

In some embodiments of alloy compositions described herein, cobalt and/or nickel are each present in an amount of 15-40 wt. %. Accordingly, the alloy compositions may be cobalt-based or nickel-based. Nickel, for example, can be present in an amount of 20-40 wt. % or 22-35 wt %. Additionally, molybdenum can be present in the alloy compositions in an amount of 25-33 wt. % or 29-33 wt. %, in some embodiments.

Table I provides alloys having composition and properties described herein.

TABLE I

Alloy Compositions

| Example | Co | Ni | Cr | Mo | Si | Fe | Mn | C | W | Configurational Entropy |
|---|---|---|---|---|---|---|---|---|---|---|
| Alloy 1 | Bal. | 1.00 | 17.50 | 25.00 | 3.20 | 14.00 | 0.50 | 0.05 | 0.00 | 1.54R |
| Alloy 2 | Bal. | 15.00 | 15.00 | 24.00 | 3.00 | 0.50 | 0.50 | 0.05 | 0.00 | 1.50R |
| Alloy 3 | Bal. | 12.00 | 17.00 | 28.00 | 3.40 | 5.00 | 0.50 | 0.05 | 0.00 | 1.66R |
| Alloy 4 | Bal. | 2.00 | 16.00 | 25.00 | 3.20 | 2.00 | 0.50 | 0.05 | 10.00 | 1.52R |
| Alloy 5 | Bal. | 16.00 | 18.00 | 23.00 | 2.70 | 0.20 | 0.30 | 0.05 | 0.00 | 1.51R |
| Alloy 6 | Bal. | 14.62 | 16.90 | 29.35 | 3.30 | 0.25 | 0.25 | 0.05 | 0.00 | 1.53R |
| Alloy 7 | Bal. | 19.32 | 16.70 | 29.80 | 3.31 | 0.25 | 0.25 | 0.05 | 0.00 | 1.57R |
| Alloy 8 | Bal. | 24.03 | 16.50 | 30.25 | 3.33 | 0.25 | 0.25 | 0.05 | 0.00 | 1.58R |
| Alloy 9 | Bal. | 28.73 | 16.30 | 30.70 | 3.34 | 0.25 | 0.25 | 0.05 | 0.00 | 1.57R |
| Alloy 10 | Bal. | 33.44 | 16.10 | 31.15 | 3.36 | 0.25 | 0.25 | 0.05 | 0.00 | 1.54R |
| Alloy 11 | Bal. | 15.30 | 16.90 | 29.35 | 3.30 | 0.50 | — | 0.05 | — | >1.5R |

Any of the alloy compositions provided in Table 1 may also exhibit a magnetic permeability less than 1.005, including 1-1.003.

II. Alloy Articles

In another aspect, articles comprising alloys described herein are provided. In some embodiments, an article comprises one or more regions formed of an alloy comprising a cobalt rich solid solution matrix phase and intermetallic precipitates dispersed in the matrix phase, the intermetallic precipitates having a discontinuous dendritic microstructure, wherein the alloy comprises 0-40 wt. % nickel, 14-20 wt. % chromium, 24-35 wt. % molybdenum, 0-15 wt. % iron, 0-1.5 wt. % manganese, 0.01-0.1 wt. % carbon, 0-15 wt. % tungsten, 0.5-5.5 wt. % silicon, and the balance cobalt. In some embodiments, the alloy composition of the article can have a composition selected from Table I above. Moreover, alloy of the article can exhibit configurational entropy and/or magnetic permeability having a value described in Section I above.

Figure 1C:
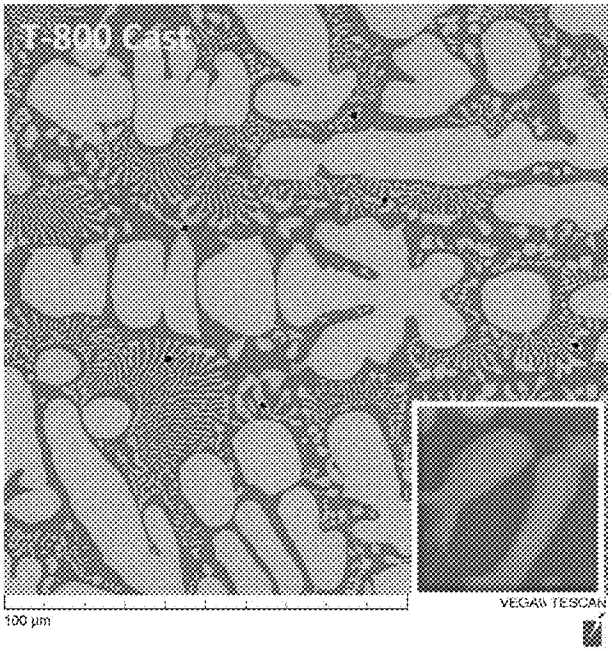
FIGS. 1B and 1C are SEMs of cast T-700 alloy and T-800 alloy, respectively, taken at the same magnification as FIG. 1A.
Figure 1B:
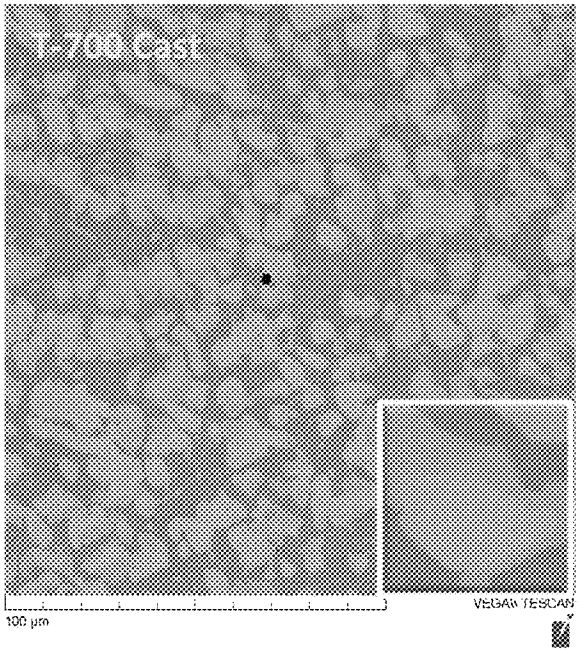

The intermetallic precipitates, in some embodiments, comprise Laves phases. FIG. 1A is an optical micrograph illustrating Laves phases of a cast alloy described herein according to one embodiment. As illustrated in FIG. 1A, the Laves phases exhibit a fine, discontinuous dendritic microstructure. For comparative purposes, FIGS. 1B and 1C are optical micrographs of cast T-700 alloy and T-800 alloy, respectively. Laves phases of the cast T-700 and T-800 alloys exhibit a much larger structure relative to FIG. 1A and are globular in nature. The fine dendritic nature of the Laves phases in alloys described herein can enhance ductility and processing capabilities without significant sacrifices to hardness, wear resistance, and/or corrosion resistance. Moreover, the fine and dispersed microstructure of the Laves phases and other intermetallic precipitates can reduce magnetic permeability of the alloy.

In some embodiments, the intermetallic precipitates are present in the alloy in an amount 50 vol. % or less. The intermetallic precipitates, for example, can be present in an amount of 30-50 vol. % or 40-48 vol. %. Additionally, the cobalt-rich solid solution matrix is face centered cubic (fcc). In some embodiments, the alloy is 30-90 vol. % fcc. The alloy may also exhibit hexagonal crystalline phases, including hexagonal close packed (hcp) phases. In some embodiments, a ratio of fcc to hcp in the alloy is greater than 2. In some embodiments, alloys having composition described herein, including the alloy compositions in Table I, can exhibit a $CoMo_3Si$ phase. Depending on specific composition, alloys described herein may exhibit one or more of the phases in Table II.

TABLE II

Alloy Phases

| |
|---|
| $Cr_{1.5}Mo_{1.5}Si$ |
| $Fe_{0.5}CoSi_{0.5}$ |
| $Co_3Mo_2Si$ |
| CoMoSi |
| CoNiSi |
| $Co_3Mo$ |
| FeMoSi |
| $Fe_xNi_ySi$ |
| $Mo_xNi_ySi_z$ |
| $Co_xMo_ySi_z$ |
| $W_2Mo_3Si$ |
| $Cr_{2.5}W_{2.5}Si_3$ |
| $Co_xMo_ySi_z$ |
| $Mo_xW_ySi_z$ |

In some embodiments, the one or more alloy regions of the article are exterior surfaces of the article. Alloys described herein can be applied as coatings via various techniques, including weld overlay via plasma transferred arc (PTA). One or multiple layers of alloy coating can be applied to an article for wear and/or corrosion resistance. Alloy compositions described herein can also be cast. In some embodiments, the entire article can be formed of the alloy composition.

Figure 2:
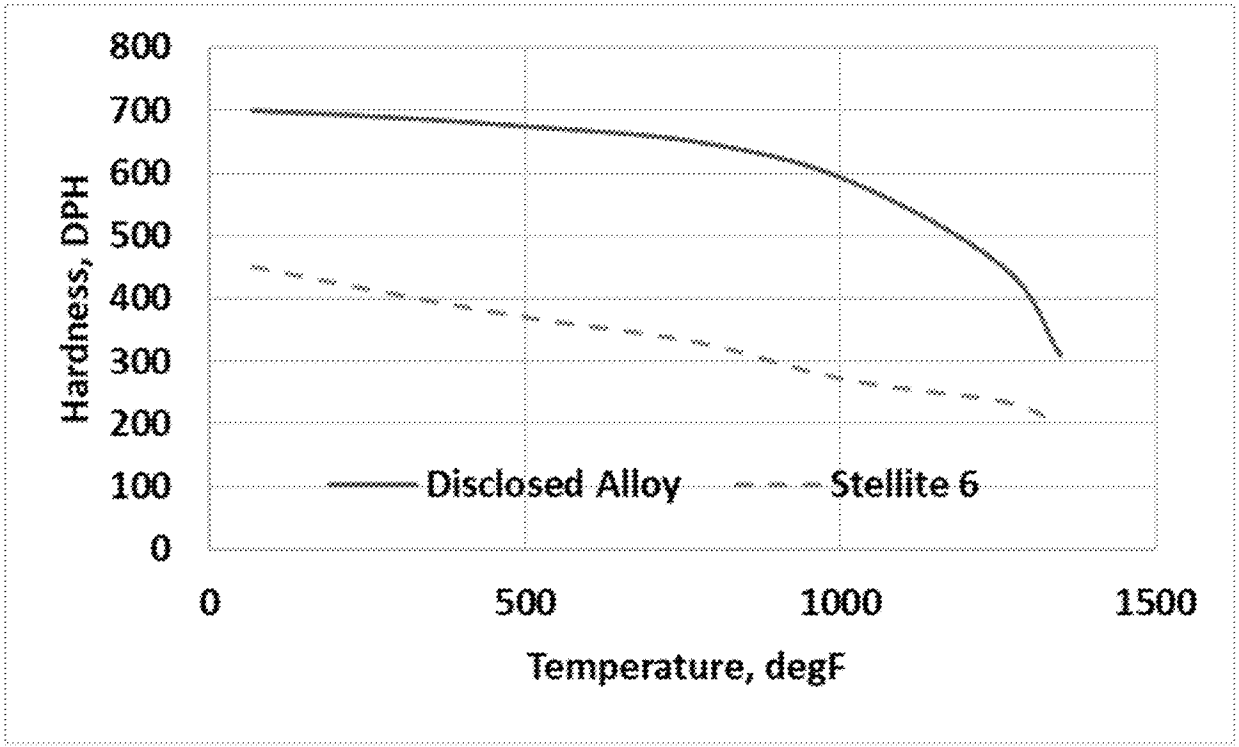
FIG. 2 illustrates hardness of an alloy described herein relative to Stellite 6, according to some embodiments.

Alloy forming one or more regions of an article can have hardness (HRC) of at least 55, in some embodiments. The alloy can also maintain desirable hardness at high temperatures. FIG. 2 illustrates hardness of an alloy disclosed herein relative to Stellite 6, according to some embodiments. As provided in FIG. 2, the alloy maintains higher hardness over a wide elevated temperature range.

Figure 3:
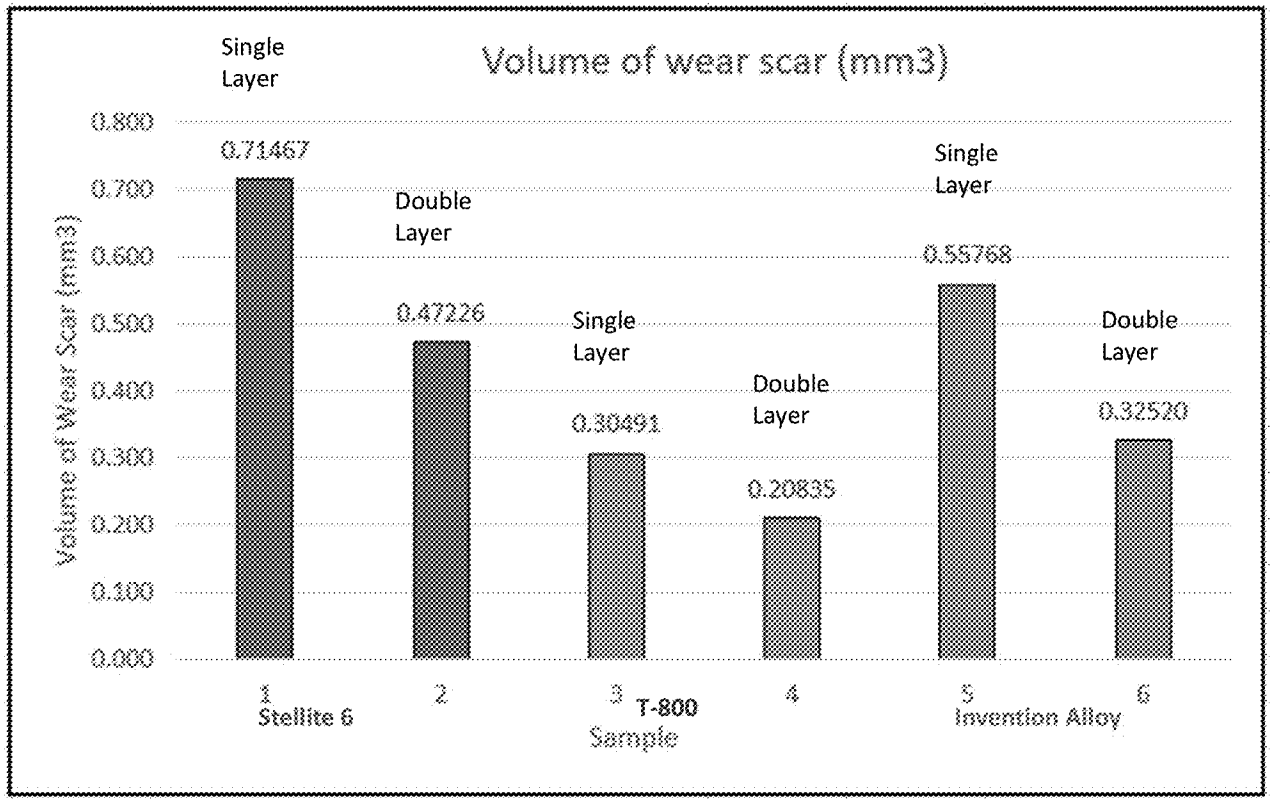
FIG. 3 illustrates wear testing of an alloy coating having composition described herein relative to Stellite 6 and Tribaloy T-800 according to some embodiments.
Figure 4:
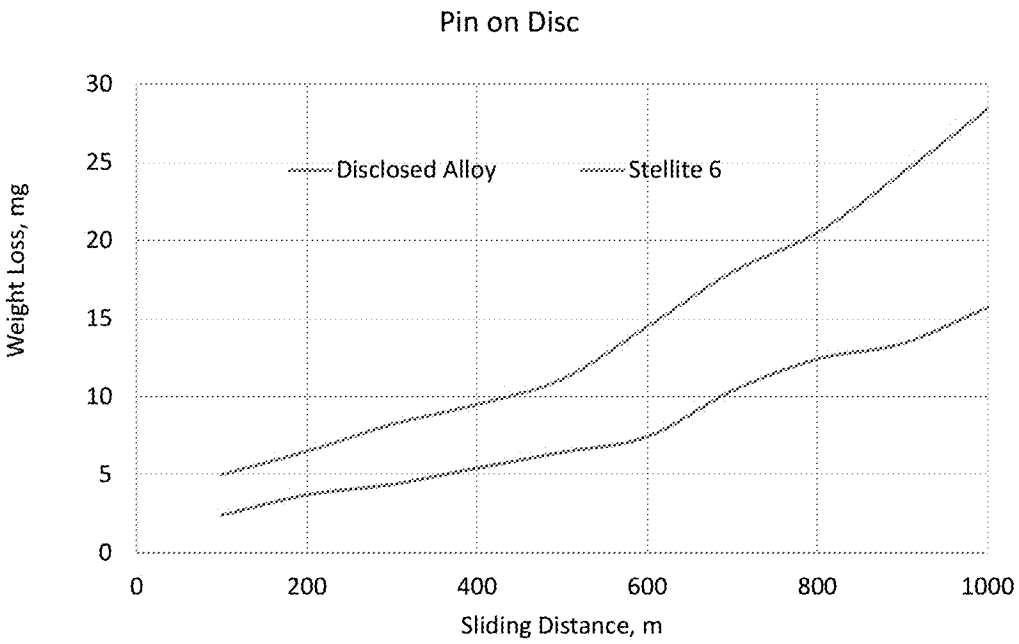
FIG. 4 illustrates sliding wear resistance testing of an alloy described herein relative to Stellite 6, according to one embodiment.

In addition to hardness, alloy described herein forming one or more regions of an article can exhibit desirable wear characteristics. FIG. 3 illustrates wear testing of an alloy coating having composition described herein (Invention Alloy) relative to Stellite 6 and Tribaloy T-800, according to some embodiments. Wear testing was conducted under ASTM G99-17 Standard Test Method for Wear Testing with Pin-on-Disk Apparatus. As illustrated in FIG. 3, the alloy exhibited wear resistance between Stellite 6 and T-800. The alloy also exhibited better sliding wear resistance relative to Stellite 6, as illustrated in FIG. 4. The wear tests were performed under dry conditions by a rotating SiC disk and an applied load of 4.9N on the pin specimen at room temperature. The line speed of the disc at the pin was 0.45 m/s, and each wear test was conducted using a fresh disc. The weight losses of the pins were measured after every 100 m of sliding distance up to 1000 m.

Figure 5:
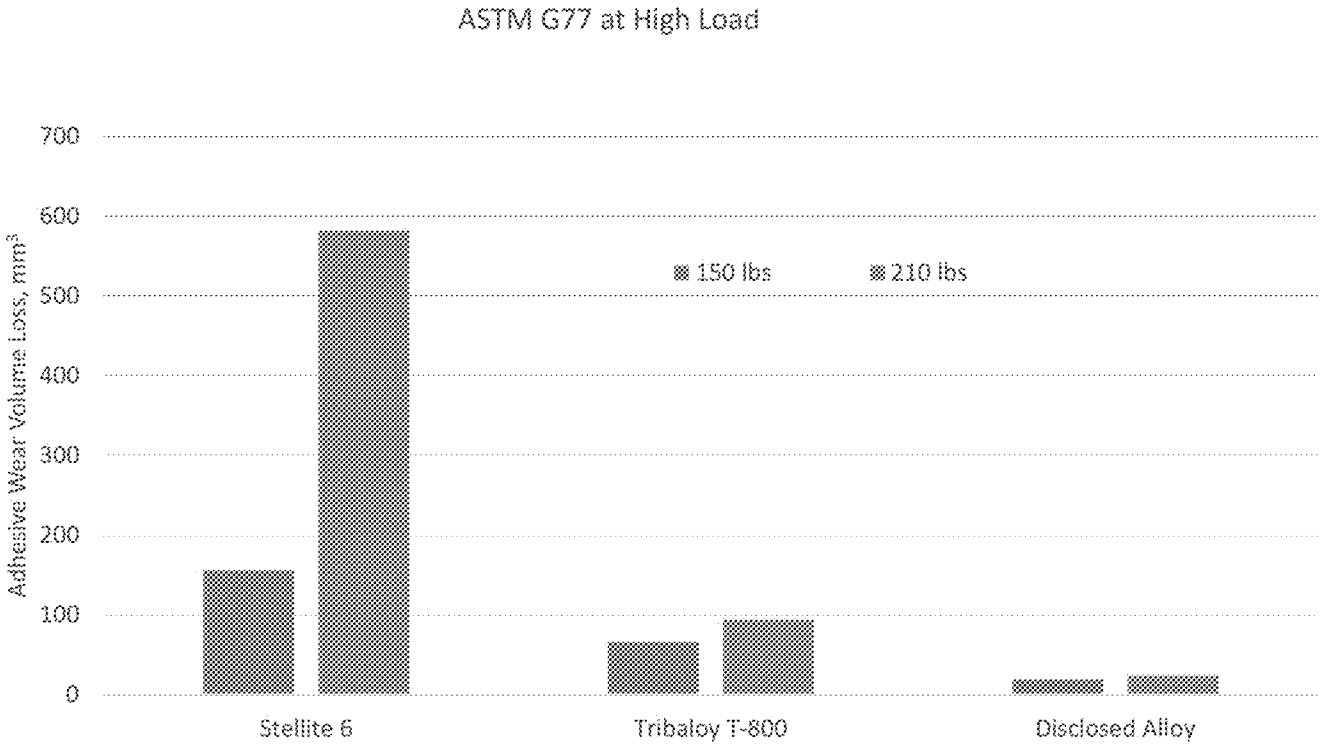
FIG. 5 illustrates adhesive wear resistance of an alloy herein relative to Stellite 6 and T-800 according to some embodiments.

Alloys having composition and microstructure described herein exhibit desirable adhesive wear resistance. FIG. 5 illustrates adhesive wear resistance of an alloy disclosed herein relative to Stellite 6 and T-800, according to some embodiments. The adhesive wear resistance testing was conducted according to ASTM G77-17-Standard Test Method for Ranking Resistance of Materials to Sliding Wear Using Block-on-Ring Wear Test. As illustrated in FIG. 5, the alloy exhibited very little volume loss.

Alloys having composition and microstructure described herein also provide higher ductility and better processing relative to brittle alloys such as T-800. Alloys described herein do not crack or are resistant to cracking when applied to substrate by various techniques, including PTA and casting.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. An alloy consisting of:

22-35 wt. % nickel, 14-20 wt. % chromium, 24-35 wt. % molybdenum, 2-5 wt. % iron, 0-1.5 wt. % manganese, 0.01-0.05 wt. % carbon, 0-15 wt. % tungsten, 0.5-5.5 wt. % silicon, and the balance cobalt, wherein the alloy has a configurational entropy greater than 1.5R, where R is the universal gas constant.

2. The alloy of claim 1, wherein the configurational entropy is up to 1.7R.

3. The alloy of claim 1 having a magnetic permeability (μ) less than 1.005.

4. The alloy of claim 1, wherein molybdenum is present in an amount of 25-33 wt. %.

5. The alloy of claim 1, wherein molybdenum is present in an amount of 29-33 wt. %.

6. An alloy consisting of:

22-35 wt. % nickel, 14-20 wt. % chromium, 24-35 wt. % molybdenum, 2-5 wt. % iron, 0-1.5 wt. % manganese, 0.01-0.05 wt. % carbon, 0-15 wt. % tungsten, 0.5-5.5 wt. % silicon, and the balance cobalt, wherein the alloy has a magnetic permeability (μ) less than 1.005.

7. The alloy of claim 6, wherein molybdenum is present in an amount of 25-33 wt. %.

8. The alloy of claim 6, wherein molybdenum is present in an amount of 29-33 wt. %.

9. The alloy of claim 6, wherein the alloy has a magnetic permeability (μ) of 1.000-1.003.

10. An article comprising:

one or more regions formed of an alloy comprising a cobalt rich solid solution matrix phase and intermetallic precipitates dispersed in the matrix phase, the intermetallic precipitates having a discontinuous dendritic microstructure, wherein the alloy comprises 22-35 wt. % nickel, 14-20 wt. % chromium, 24-35 wt. % molybdenum, 2-5 wt. % iron, 0-1.5 wt. % manganese, 0.01-0.05 wt. % carbon, 0-15 wt. % tungsten, 0.5-5.5 wt. % silicon, and the balance cobalt, wherein the intermetallic precipitates are of the formula $M_1M_2Si$, wherein $M_1$ and $M_2$ are different, and $M_1$ is selected from the group consisting of Cr, Fe, Co, Mo, and W, and $M_2$ is selected from the group consisting of Mo, Co, Ni, and W.

11. The article of claim 10, wherein the intermetallic precipitates comprise Laves phases.

12. The article of claim 10, wherein the intermetallic precipitates are present in an amount less than 50 vol. % of the cobalt-based alloy.

13. The article of claim 10, wherein the intermetallic precipitates are present in an amount of 30-50 vol. % of the cobalt-based alloy.

14. The article of claim 10, wherein the alloy has a magnetic permeability (μ) less than 1.005.

15. The article of claim 14, wherein the alloy has a magnetic permeability (μ) of 1.000-1.003.

16. The article of claim 10, wherein the alloy has a configurational entropy of greater than 1.5R, wherein R is the universal gas constant.

17. The article of claim 16, wherein the configurational entropy is up to 1.7R.

18. The article of claim 10, wherein the cobalt rich solid solution matrix phase is face centered cubic.

19. The article of claim 14, wherein 30-90 vol. % of the alloy is face centered cubic.

20. The article of claim 19, wherein a ratio of cubic phase to hexagonal phase in the alloy is greater than 2.

21. The article of claim 10, wherein the article is a tool.

22. The article of claim 10, wherein the one or more regions comprise a coating.

23. An article comprising:

one or more regions formed of an alloy comprising a cobalt rich solid solution matrix phase and intermetallic precipitates dispersed in the matrix phase, the intermetallic precipitates having a discontinuous dendritic microstructure, wherein the alloy comprises 22-35 wt. % nickel, 14-20 wt. % chromium, 24-35 wt. % molybdenum, 2-5 wt. % iron, 0-1.5 wt. % manganese, 0.01-0.05 wt. % carbon, 0-15 wt. % tungsten, 0.5-5.5 wt. % silicon, and the balance cobalt, wherein the alloy comprises a $CoMo_3Si$ phase.

* * * * *